US006419115B1

(12) United States Patent
Logan, Jr.

(10) Patent No.: US 6,419,115 B1
(45) Date of Patent: Jul. 16, 2002

(54) APPARATUS AND METHOD FOR FACILITATING THE EMPTYING OF TUBE DISPENSERS

(76) Inventor: William D. Logan, Jr., 518 Woodland Hills Dr., Carthage, MS (US) 39051

( * ) Notice: Subject to any disclaimer, the term of this patent is extended or adjusted under 35 U.S.C. 154(b) by 0 days.

(21) Appl. No.: 09/593,017

(22) Filed: Jun. 13, 2000

(51) Int. Cl.[7] ..... B65D 35/28
(52) U.S. Cl. ..... 222/1; 222/107; 222/97
(58) Field of Search ..... 222/1, 95, 97, 222/98, 99, 100, 103, 107; 132/245, 246, 247, 248, 259, 260

(56) References Cited

U.S. PATENT DOCUMENTS

| | | | | | |
|---|---|---|---|---|---|
| 1,920,690 | A | * | 8/1933 | Fraser et al. | 132/247 |
| 1,945,932 | A | * | 2/1934 | Caley | 132/247 |
| 2,378,872 | A | * | 6/1945 | Stone | 132/247 |
| 2,415,914 | A | * | 2/1947 | Silverman | 132/247 |
| 2,672,258 | A | | 3/1954 | Marberg | 222/100 |
| 2,862,647 | A | * | 12/1958 | Dietz | 222/99 |
| 2,903,162 | A | * | 9/1959 | Regan | 222/99 |
| 3,203,596 | A | | 8/1965 | Davidson | 222/103 |
| 3,463,359 | A | | 8/1969 | Piggush | 222/103 |
| 3,628,696 | A | | 12/1971 | Duiker | 222/242 |
| 4,452,823 | A | | 6/1984 | Connolly et al. | 426/115 |
| 4,576,314 | A | | 3/1986 | Elias et al. | 222/97 |
| 4,653,670 | A | | 3/1987 | Kendrick | 222/99 |
| 4,664,293 | A | | 5/1987 | Sheppard | 222/99 |
| 4,778,082 | A | * | 10/1988 | Vitelle | 222/95 |
| 4,807,782 | A | | 2/1989 | Meinerding et al. | 222/1 |
| 5,014,879 | A | | 5/1991 | Hill | 222/99 |
| 5,082,144 | A | | 1/1992 | Sundstrom | 222/99 |
| 5,094,362 | A | | 3/1992 | Dickens | 222/99 |
| 5,167,348 | A | | 12/1992 | Okami et al. | 222/103 |
| 5,178,301 | A | | 1/1993 | McGanty | 222/99 |
| 5,205,438 | A | | 4/1993 | Southard | 222/1 |
| 5,373,968 | A | | 12/1994 | Nelson | 222/99 |
| 5,381,929 | A | | 1/1995 | Salz | 222/99 |
| 5,472,118 | A | | 12/1995 | Nelson | 222/99 |
| 5,480,065 | A | | 1/1996 | Powers | 222/99 |
| 5,579,956 | A | * | 12/1996 | Seale | 222/107 |
| 5,857,593 | A | * | 1/1999 | Patronaggio | 222/103 |
| 5,975,363 | A | * | 11/1999 | Haycock | 222/103 |
| 6,155,458 | A | * | 12/2000 | Picard | 222/103 |

* cited by examiner

*Primary Examiner*—William C. Doerrler
*Assistant Examiner*—Patrick Buechner
(74) *Attorney, Agent, or Firm*—Thompson & Knight L.L.P.; Darin M. Klemchuk

(57) ABSTRACT

A collapsible tube squeezer assists the process of dispensing the content of a collapsible tube, and holds the wound emptied portion of the tube. A tube squeezer is formed from a continuous strip of material, with a long slot where the sealed end of the tube can be inserted. As the tube squeezer is pushed toward the dispensing end of the tube, the material stored in the tube can be forced out of the dispensing end. At the same time, the emptied portion of the tube is left flat, so that it can be easily rolled to the tube squeezer position. Locking arms can then be pulled across the rolled tube. A locking mechanism at the ends of the locking arms is engaged to hold the rolled tube in place.

20 Claims, 5 Drawing Sheets

APPARATUS AND METHOD FOR FACILITATING THE EMPTYING OF TUBE DISPENSERS

FIELD OF THE INVENTION

This invention relates generally to devices for facilitating the emptying of collapsible tube dispensers.

BRIEF DESCRIPTION OF THE PRIOR ART

As is well known in the art, collapsible tube dispensers that store viscous materials, commonly referred to as "squeeze tubes," have a wide variety of applications in housewares, industrial, medical, military, food and beverage industry, and other uses. A common example of the squeeze tube is the toothpaste dispenser.

Customary usage of squeeze tubes involves squeezing the end of the tube opposite the dispensing end and rolling the end of the tube toward the dispensing end. Because squeeze tubes were customarily constructed of malleable and ductile metallic compounds, the tubes would retain their shape following squeezing, and thus, the tube would remain largely in its rolled position following the rolling operation.

However, the application of flexible synthetic resins and plastics to squeeze tubes has resulted in the tubes that unwind after being squeezed and rolled. This result may create voids within the plastic tube. These voids make the tube to appear empty when it is not or allow for possible contamination of the remaining contents of the tube. As a result, squeeze tubes are often thrown out before all of their contents have been dispensed.

The prior art discloses numerous devices for dispensing material stored in collapsible tubes. One approach is the turn-key device of Powers U.S. Pat. No. 5,480,065. As the handle of the turn key device is turned, the collapsible tube is wound about the turn key, thereby collapsing the tube and dispensing its contents. Hill U.S. Pat. No. 5,014,879 and Dickens U.S. Pat. No. 5,094,362 disclose similar turn-key devices.

Another approach is that disclosed in McGanty U.S. Pat. No. 5,178,301. McGanty employs a slotted device, which has one slot for the squeeze tube end to be inserted and another for a locking mechanism to be inserted following rolling of the tube. The tube is first inserted into the long slot and wound about the device. Once the tube has been adequately squeezed, the locking mechanism is inserted into the second slot. The tube is then retained in the squeezed position until its next use.

Still other alternative approaches are disclosed in Okami et al. U.S. Pat. No. 5,167,348 and Sundstrom U.S. Pat. No. 5,082,144.

These approaches have many disadvantages. Often, as is the case with the Powers device, the squeezing apparatus is bulky making it disadvantageous for certain uses. Moreover, many of the device are comprised of several or relatively complicated parts resulting in more expensive manufacturing and shipping costs.

SUMMARY OF THE INVENTION

The present invention relates to tube squeezers, and in particular a tube squeezer that is simple to use, of simple construction, and inexpensive to manufacture and ship.

It is an object of the present invention to provide an effective and easy method of dispensing material stored in collapsible tube dispensers. It is a further object of the present invention to provide a device with only one component, having the ability to reliably and easily dispense material and retain the collapsible tube in a collapsed condition.

It is a further object of the present invention to provide a dispensing mechanism that sufficiently exerts enough pressure against the collapsible tube to dispense all of the material stored in the collapsible tube, thereby eliminating voids in the tube and contamination of the contents of the tube.

It is a further object of the present invention to provide a dispenser capable of accommodating a variety of squeeze tube widths.

It is a further object of the present invention to provide a dispenser that is inexpensively and easily manufactured. It is still another object of the present invention to provide a dispenser that may be cost-effectively shipped and stored, and that may be thrown away following its use.

It is a further object of the present invention to provide a dispenser capable of providing dispensing functions, and yet allow for advertising or promotion in conjunction with the dispensing function.

BRIEF DESCRIPTION OF THE DRAWINGS

Other objects, advantages, features and characteristics of the present invention, as well as methods, operation and functions of related elements of structure, and the combination of parts and economies of manufacture, will become apparent upon consideration of the following description and claims with reference to the accompanying drawings, all of which form a part of this specification, wherein like reference numerals designate corresponding parts in the various figures, and wherein:

DESCRIPTION OF THE PREFERRED EMBODIMENT

In the following detailed description of the preferred embodiments, reference is made to the accompanying drawings which form a part hereof, and in which is shown by way of illustration specific preferred embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Figure 1:
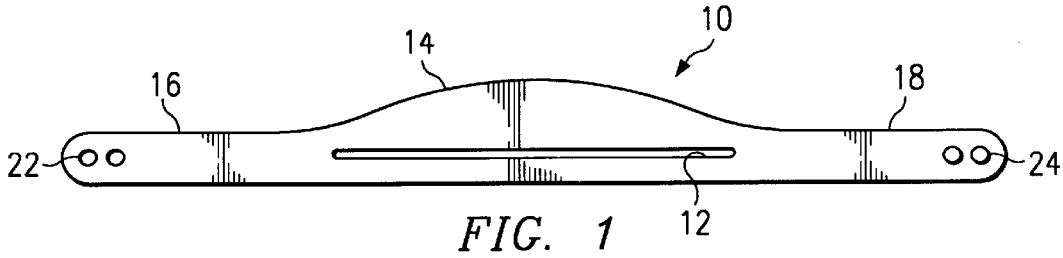
FIG. 1 is a plan view of the present invention.
Figure 2:
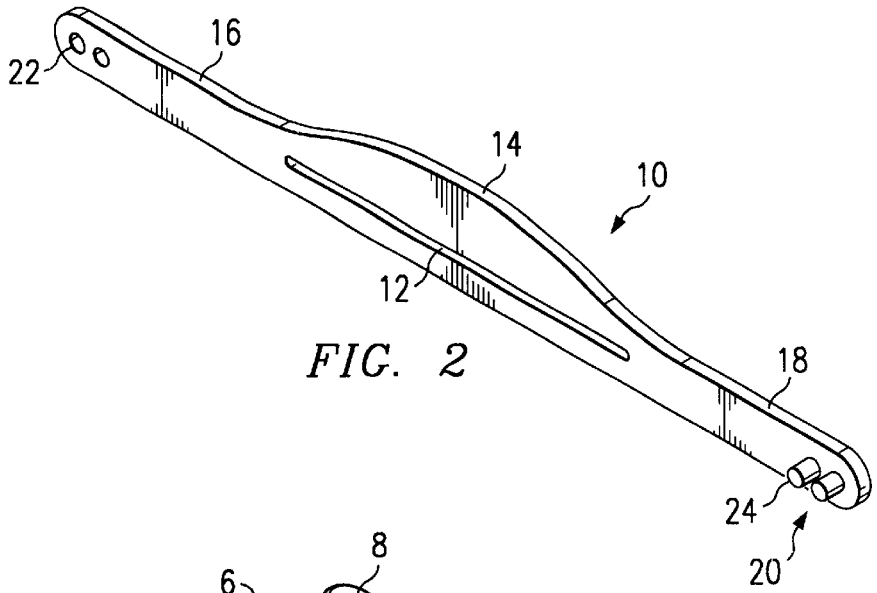
FIG. 2 is a perspective view of the present invention.

The present invention comprises an apparatus and method for facilitating the emptying of collapsible tubes. The tube squeezer is shown in its entirety in FIGS. 1 through 10. FIGS. 1 and 2 show the basic components of the tube squeezer 10. In accordance with the preferred embodiment, tube squeezer 10 includes a longitudinal slot 12, an arched edge 14, locking arms 16 and 18, and a locking mechanism 20 that preferably includes locking elements 22 and 24.

Figure 3:
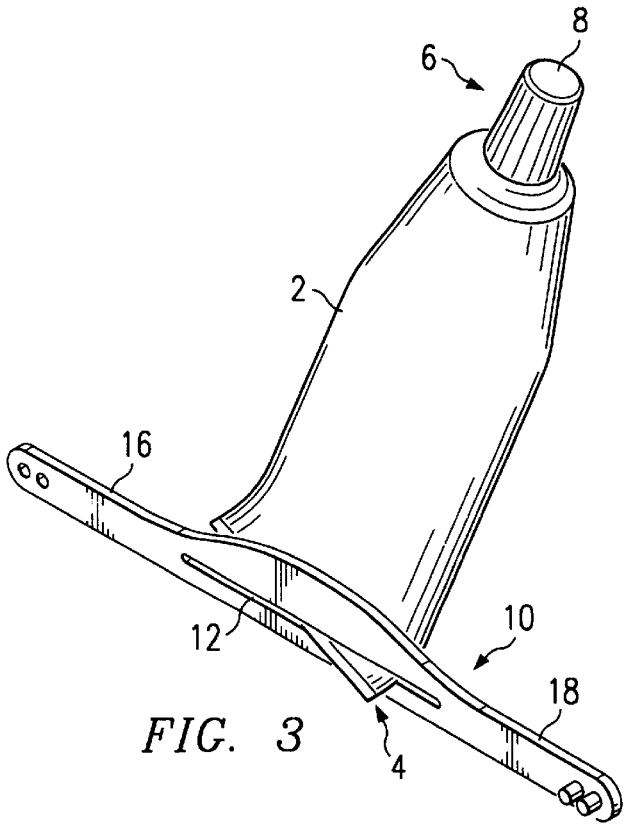
FIG. 3 is a perspective view of the present invention with the edge of the collapsible tube inserted into the slot.
Figure 4:
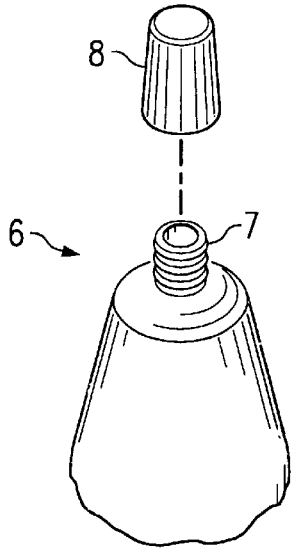
FIG. 4 is a perspective view of the collapsible tube with the cap removed.

FIGS. 3 and 4 show the tube 2 with a sealed end 4, a dispensing end 6, a dispenser 7 on the dispensing end 6, and a cap 8 attached to the dispenser 7. The sealed end 4 of the tube 2 is opposite the dispensing end 6 of the tube. To use the tube squeezer 10, the sealed end 4 of the tube 2 is inserted into slot 12 of the tube squeezer 10. FIG. 4 shows the tube 2 with the cap 8 removed from the dispenser 7.

One skilled in the art will appreciate that tube squeezer 10 may be fabricated easily and inexpensively of existing plastic materials, such as polystyrene, polypropylene, cellulose acetate, and the like. The tube squeezer may also be fabricated from ceramic, metallic, and alloy materials as well. One skilled in the art would further appreciate that the tube squeezer may be fabricated from one continuous piece of substantially-flat material. Such single piece of material fabrication is preferred because it reduces manufacturing costs and enhances shipping of the tube squeezer to customers of the product. As a result of the reduced manufacturing and shipping costs, the tube squeezer's cost may be so low that it may be used as a disposable device.

Figure 5:
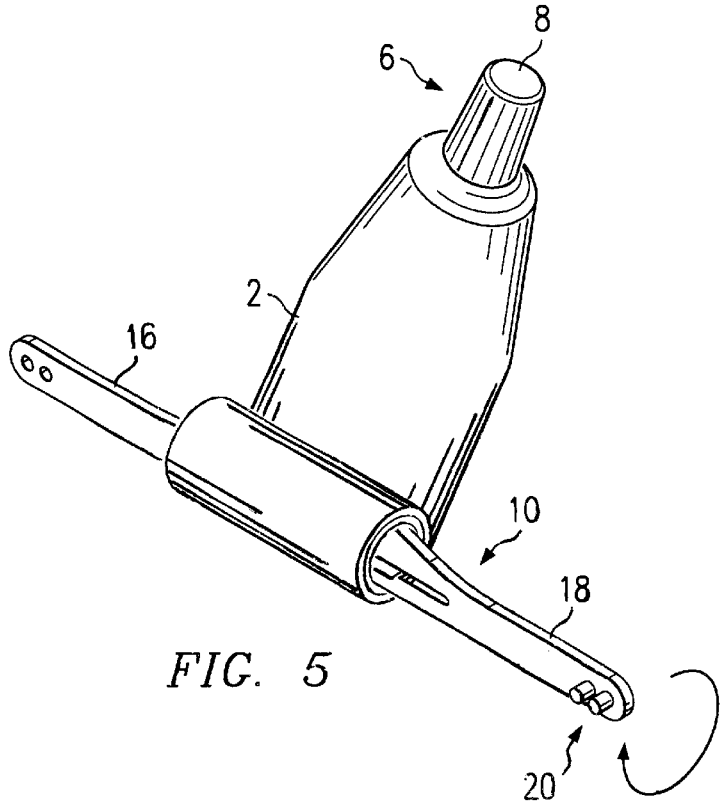
FIG. 5 is a perspective view of the present invention showing the collapsible tube in the wound, but unlocked position.

Turning to FIG. 5, the tube squeezer 10 is shown in the initial squeezing position with the sealed end 4 of the tube inserted into slot 12. The tube contents can be dispensed by removing the cap 8 from the dispenser 7 and pushing the tube squeezer 10 toward the dispensing end 6 until the material stored in the tube emerges from the dispenser 7. Alternatively, the tube contents can also be dispensed by manually squeezing the tube 2, beginning with the sealed end 4, toward the dispensing end 6. After a portion of the tube contents have been dispensed from the dispenser 7, the cap 8 is reattached to the dispenser 7. With the locking mechanism 20 on the tube squeezer 10 unfastened, the tube 2 is squeezed by pushing the tube squeezer 10 toward the dispensing end 6, forcing the contents toward the dispensing end 6 until the tube contents are tightly packed at the dispensing end 6 of the tube 2.

Figure 7:
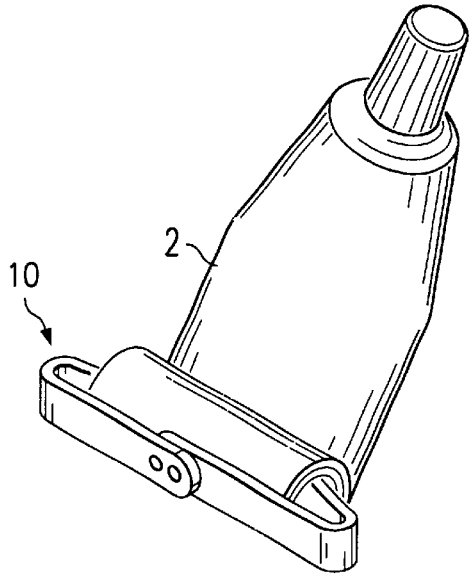
FIG. 7 is a perspective view of the collapsible tube in the wound and locked position.

With the tube squeezer 10 pushed as close to the dispensing end as the contents will permit, the sealed end 4 of the tube is folded either upward or 5 downward and wound toward the dispensing end 6 of tube 2. Alternatively, the tube squeezer 10 may be slid along the tube 2 to the sealed end 4, and the sealed end 4 and the tube squeezer 10 may be rolled together until the tube 2 is sufficiently rolled. When the wound tube body includes all of the tube material below the tube squeezer 10, the locking arms 16 and 18 of the tube squeezer 10 are brought together over the 10 rolled tube material and the locking mechanism 20 is engaged by connecting the first locking element 22 to second locking element 24. In this way, the rolled tube material is kept tightly rolled, while the contents of the tube are entirely contained in the dispensing end 6 of the tube 2. FIG. 7 illustrates the tube squeezer in the locked position.

The contents of the tube 2 may be further dispensed from the dispenser 7 by unlocking the locking mechanism 20, straightening locking arms 16 and 18, and unwinding the tube 2. Next, the tube squeezer 10 is slid about the tube 2 toward the sealed end 4 of the tube 2 sufficiently to allow either manual squeezing of the tube 2 or to allow the tube squeezer 10 to be pushed against tube 2 toward the dispensing end 6 further dispensing the contents.

One skilled in the art can easily recognize that the slot 12 can be made in various widths and locking arms 16 and 18 can be made in various lengths to accommodate a variety of different tube widths.

Arched edge 14 is arched away from the edge of the slot 12, as is shown in FIG. 2. The arched region provides a finger-hold as the tube squeezer 10 is drawn up the tube 2, squeezing the contents of the tube 2 toward the dispensing end 6. One skilled in the art can easily recognize that other configurations could be used to achieve the same function.

Figure 6:
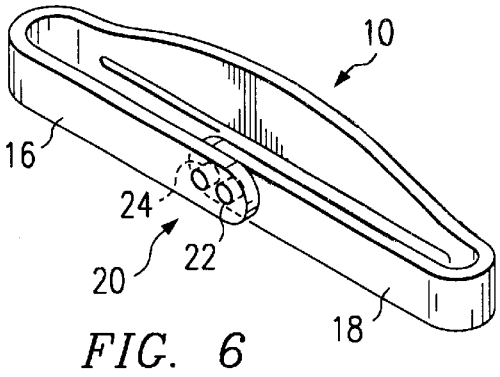
FIG. 6 is a perspective view of the present invention in the locked position.

FIG. 7 illustrates the tube squeezer 10 locked in place about a wound tube 2. FIG. 6 is a plan view of the tube squeezer 10 in the locked position.

Figure 8:
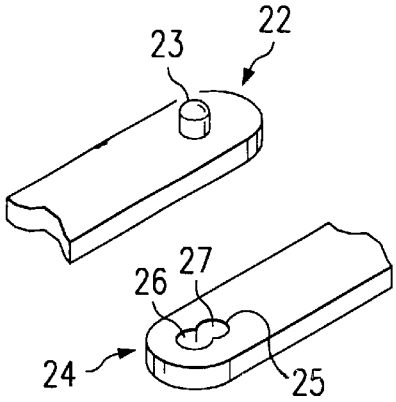
FIG. 8 is a perspective view of one embodiment of the locking mechanism.

Locking is achieved by coupling the first and second locking elements 22 and 24 of the locking arms 16 and 18 of the tube squeezer 10. One skilled in the art would easily recognize that the locking function can be achieved by a variety of means. FIG. 8 illustrates one embodiment of the locking mechanism. In accordance with the preferred embodiment, one locking element 22 includes a single pronged device 23 and another locking element 24 that includes a recessed area 25 to receive the prong 23 of element 22. The recessed area 25 includes two regions, one region 26 cylindrical in shape with a radius slightly larger than prong 23 and another region 27 similarly cylindrical in shape with a radius slightly smaller than prong 23. The regions abut each other so that the prong 23 may slide from one region to another.

To lock the locking elements, prong 23 is first inserted into the larger region 26 of the recessed area 25, then the prong 23 is slid toward the smaller region 27, which snugly fastens the prong 23 to the recessed area 25. This configuration is commonly referred to as a key hole locking mechanism. The locking mechanism 20 is unlocked by sliding the prong 23 toward the larger region 26 of the recessed area 24 and removing the prong 23 from the recessed area 24.

Figure 9:
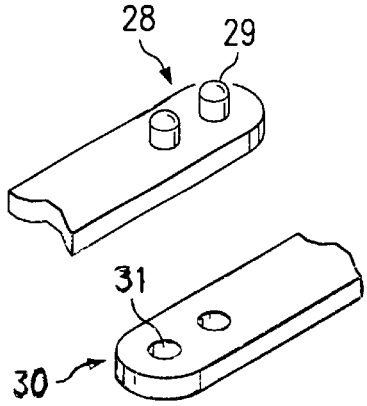
FIG. 9 is a perspective view of an alternative embodiment of the locking mechanism.

Another embodiment of the locking mechanism 20 is shown in FIG. 9. Locking element 28 includes a double-prong device 29 and the other locking element 30 includes a recessed area 31 to receive the prongs 29 of element 28. The tube squeezer 10 is locked by inserting the prongs 29 into recessed area 31. The tube squeezer 10 can be unlocked, thereby allowing for further winding of the tube 2, by minimal pressure exerted against the ends in the opposing direction of the opposing locking elements. One skilled in the art would appreciate that a variety of different commonly-known devices may be used as locking elements, such as twist wraps, Velcro®, snap assemblies, buckle assemblies, and the like.

In yet another embodiment of the invention, locking arms 16 and 18 are enlarged to approximately twice their width to facilitate the use of graphics and writings, which may include logos, slogans, and other forms of advertisements.

Figure 10:
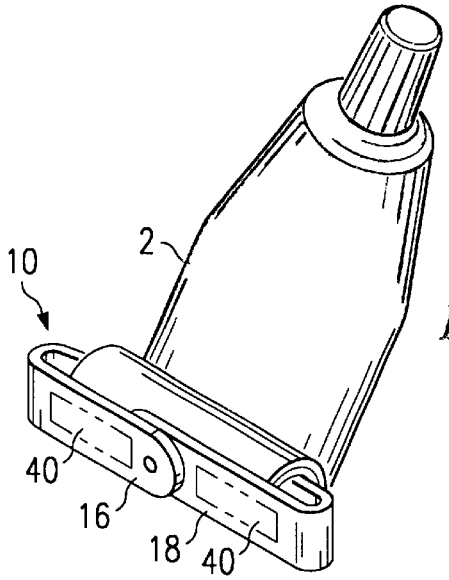
FIG. 10 is a perspective view of an alternative embodiment of the locking arms.

FIG. 10 illustrates locking arms 16 and 18 which include a logo 40 placed on them that is visible to the user of the tube squeezer 10 while the locking arms are in the locked position.

Figure 11:
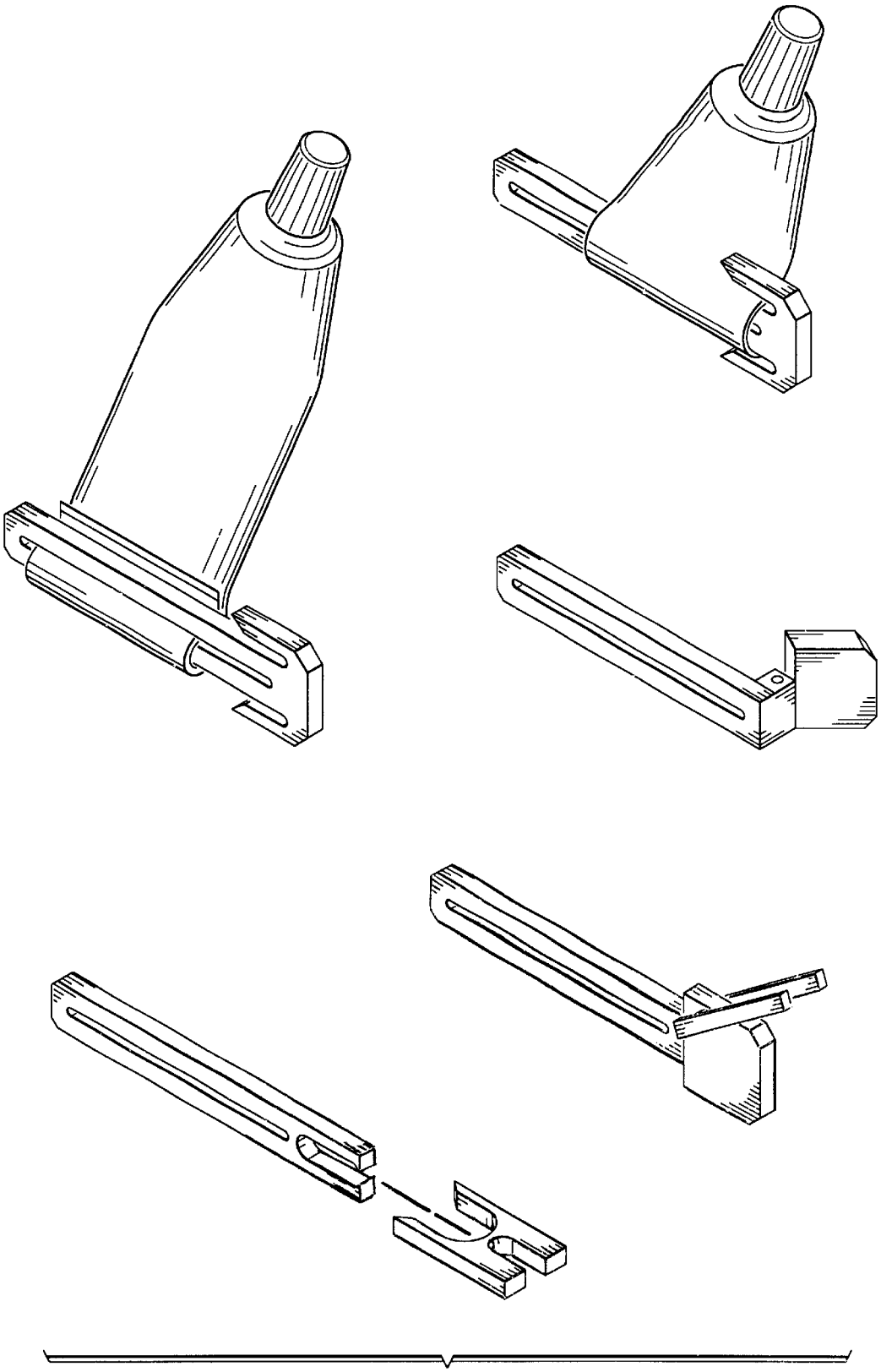
FIG. 11 (PRIOR ART)
FIG. 11 is a perspective view of prior art.
Figure 12:
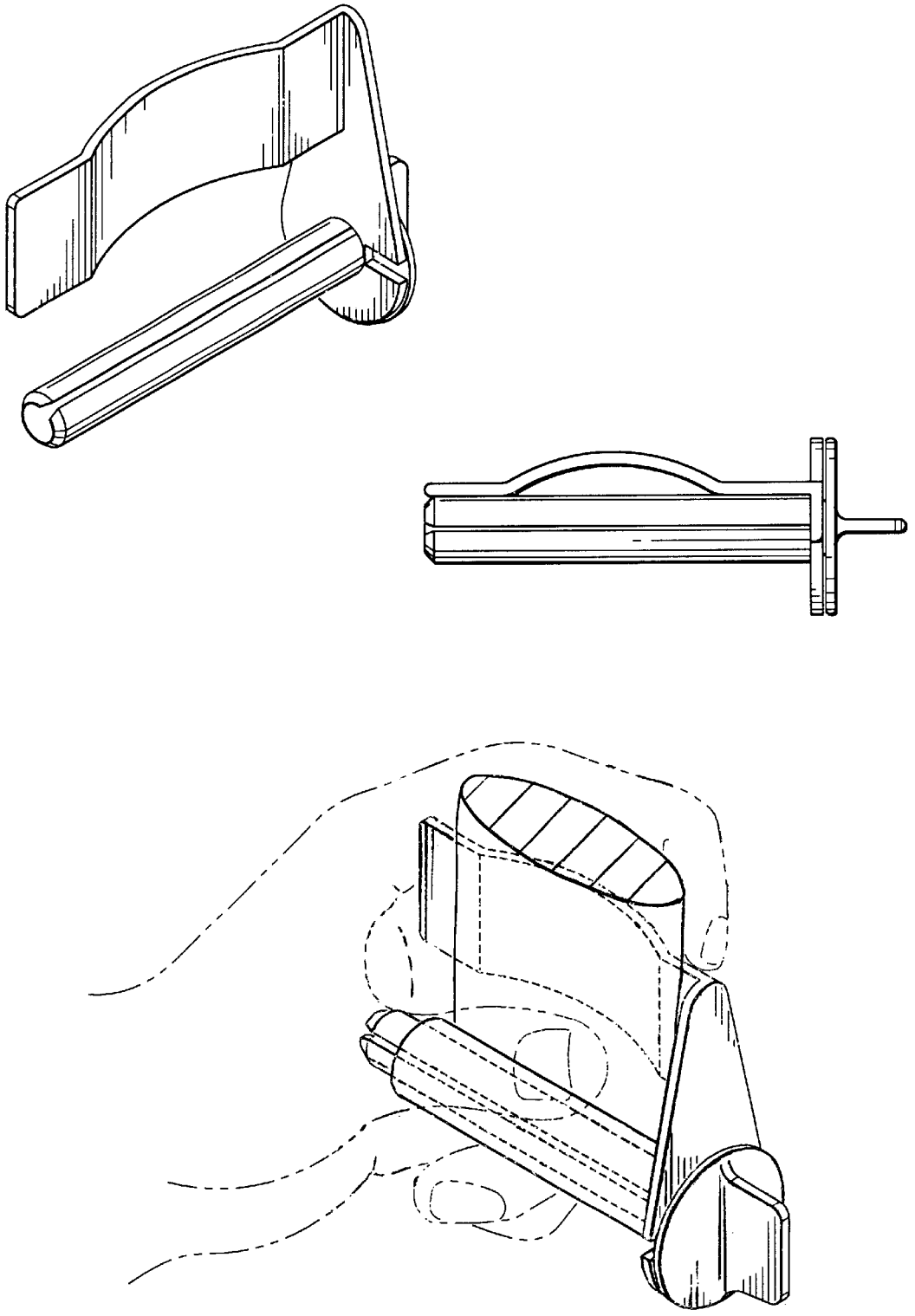
FIG. 12 (PRIOR ART)
FIG. 12 is a perspective view of prior art.

The preferred embodiment of the present invention dispenses with the need for non-integral components to be added to perform the locking mechanism's function. Rather, the device employs a single, continuous piece of material. FIGS. 11 and 12 depict prior art, which require non-integral components. Because the present invention is substantially flat, it may easily be shipped with relatively low cost. The low cost of the present invention is further advantageous in that it allows the device to be used in a disposable manner.

Although the invention has been described with a certain degree of particularity, it should be recognized that elements thereof may be altered by persons skilled in the art without departing from the spirit and scope of the invention. The invention is limited only by the following claims and their equivalents.

What is claimed is:

1. A collapsible tube squeezer comprising:

a substantially-flat body fabricated from one continuous piece of material and including:

a longitudinal slot capable of receiving and holding a collapsible tube;

locking arms extending from both ends of the longitudinal slot; and a locking mechanism, comprising a first locking element at the end of a first locking arm and a second locking element at the end of a second locking arm, located on the locking arms of the squeezer, capable of locking the squeezer in place about the collapsible tube, thereby preventing the tube from unwinding;

wherein the collabsible tube squeezer is adapted for use with a collapsible squeeze tube.

2. A collapsible tube squeezer as recited in claim 1, wherein the first locking element is comprised of prongs and the second locking element is comprised of recessed areas.

3. A collapsible tube squeezer as recited in claim 1, wherein the first locking element is comprised of a single prong and the second locking element is comprised of a key hole recessed area.

4. A collapsible tube squeezer as recited in claim 1, wherein the body further includes two longitudinal edges substantially parallel to the longitudinal slot, wherein at least one of the longitudinal edges is arched away from the slot and wherein the first locking element is comprised of prongs and the second locking element is comprised of recessed areas.

5. A collapsible tube squeezer as recited in claim 4, wherein the first locking element is comprised of a single prong and the second locking element is comprised of a key hole recessed area.

6. A collapsible rube squeezer comprising:

a substantially-flat body fabricated from one continuous piece of material a including:

a longitudinal slot capable of receiving and holding a collapsible tube;

locking arms extending from both ends of the longitudinal slot, wherein the locking arms include a logo, slogan, or other form of advertisement on the outside face of the locking arms visible to a tube squeezer user while the locking arms are in a locked position about the collapsible tube; and a locking mechanism, comprising a first locking element at the end of a first locking arm and a second locking element at the end of a second locking arm, located on the locking arms of the squeezer, capable of locking the squeezer in place about the collapsible tube, thereby prevent the tube from unwinding;

wherein the collabsible tube sqeezer is adapted for use with a collapsible squeeze tube.

7. A collapsible tube squeezer as recited in claim 6, wherein the first locking element is comprised of prongs and the second locking element is comprised of recessed areas.

8. A collapsible tube squeezer as recited in claim 6, wherein the first locking element is comprised of a single prong and the second locking element is comprised of a key hole recessed area.

9. A collapsible tube squeezer as recited in claim 6, wherein the body further includes two longitudinal edges substantially parallel to the longitudinal slot, wherein at least one of the longitudinal edges is arched away from the slot and wherein the first locking element is comprised of prongs and the second locking element is comprised of recessed areas.

10. A collapsible tube squeezer as recited in claim 9, wherein the first locking element is comprised of a single prong and the second locking element is comprised of a key hole recessed area.

11. A method of facilitating the dispensing of material from a collapsible tube, comprising the steps of:

inserting the sealed end of a collapsible tube into the longitudinal slot of the tube squeezer, the collapsible tube having collapsible walls, a sealed end and a dispensing end, the tube squeezer, formed of a substantially-flat body fabricated from one continuous piece of material, including a longitudinal slot capable of receiving and holding a collapsible tube, locking arms extending from both ends of the longitudinal slot and a locking mechanism comprising a first locking element at the end of the first locking arm and a second locking element at the end of a second locking arm, located on the locking arms of the squeezer, capable of locking the squeezer in place about the collapsible tube, thereby preventing the tube from unwinding;

pushing the tube squeezer along the collapsible walls toward the dispensing end;

winding the collapsible walls from the sealed end toward the dispensing end to form a wound portion of tube and continuing the winding until a desired amount of material is dispensed from the collapsible tube; and locking the squeezer by bringing the locking arms together and engaging the locking mechanism.

12. A method as claimed in claim 11, wherein the first locking element is comprised of prongs and the second locking element is comprised of recessed areas.

13. A method as claimed in claim 11, wherein the first locking element is comprised of a single prong and the second locking element is comprised of a key hole recessed area.

14. A method as claimed in claim 11, wherein the body further includes two longitudinal edges substantially parallel to the longitudinal slot, wherein at least one of the longitudinal edges is arched away from the slot and wherein the first locking element is comprised of prongs and the second locking element is comprised of recessed areas.

15. A method as claimed in claim 14, wherein the first locking element is comprised of a single prong and the second locking element is comprised of a key hole recessed area.

16. A method as claimed in claim 11, wherein the locking arms include a logo, slogan, or other form of advertisement on the outside face of the locking arms visible to the tube squeezer user while the locking arms are in a locked position about the collapsible tube.

17. A method as claimed in claim 16, wherein the first locking element is comprised of prongs and the second locking element is comprised of recessed areas.

18. A method as claimed in claim 16, wherein the first locking element is comprised of a single prong and the second locking element is comprised of a key hole recessed area.

19. A method as claimed in claim 16, wherein the body further includes two longitudinal edges substantially parallel to the longitudinal slot, wherein at least one of the longitudinal edges is arched away from the slot and wherein the first locking element is comprised of prongs and the second locking element is comprised of recessed areas.

20. A method as claimed in claim 19, wherein the first locking element is comprised of a single prong and the second locking element is comprised of a key hole recessed area.

* * * * *